US010903605B2

(12) United States Patent
Mamiya et al.

(10) Patent No.: US 10,903,605 B2
(45) Date of Patent: Jan. 26, 2021

(54) CONNECTOR WITH A RETAINER OPERABLE BY A TOOL

(71) Applicant: Sumitomo Wiring Systems, Ltd., Mie (JP)

(72) Inventors: Yuma Mamiya, Mie (JP); Shinjiro Kida, Mie (JP); Sho Saito, Mie (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/676,860

(22) Filed: Nov. 7, 2019

(65) Prior Publication Data

US 2020/0153162 A1 May 14, 2020

(30) Foreign Application Priority Data

Nov. 14, 2018 (JP) ..... 2018-213442

(51) Int. Cl.

| | |
|---|---|
| ***H01R 13/627*** | (2006.01) |
| ***H01R 13/428*** | (2006.01) |
| ***H01R 13/453*** | (2006.01) |
| ***H01R 13/436*** | (2006.01) |
| *H01R 107/00* | (2006.01) |

(52) U.S. Cl.

CPC ..... *H01R 13/6272* (2013.01); *H01R 13/428* (2013.01); *H01R 13/4365* (2013.01); *H01R 13/4538* (2013.01); *H01R 2107/00* (2013.01)

(58) Field of Classification Search

CPC ..... H01R 13/6272; H01R 13/428; H01R 13/4223; H01R 13/4365; H01R 2107/00; H01R 13/453; H01R 13/4538; H01R 13/6271; H01R 13/6275; H01R 13/502

USPC ..... 439/258, 140, 141, 352, 357

See application file for complete search history.

(56) References Cited

U.S. PATENT DOCUMENTS

| | | | | |
|---|---|---|---|---|
| 5,967,859 | A * | 10/1999 | Cecil, Jr. ..... | H01R 13/4368 439/752 |
| 6,165,011 | A * | 12/2000 | Fukuda ..... | H01R 13/4223 439/595 |
| 6,851,987 | B2 * | 2/2005 | Mase ..... | H01R 13/506 439/752 |
| 7,458,832 | B2 * | 12/2008 | Shibata ..... | H01R 13/64 439/157 |
| 9,455,521 | B2 * | 9/2016 | Bang ..... | H01R 13/62938 |
| 10,535,952 | B2 * | 1/2020 | Mamiya ..... | H01R 13/62938 |
| 2006/0035536 | A1 * | 2/2006 | Sai ..... | H01R 13/4365 439/752 |

(Continued)

FOREIGN PATENT DOCUMENTS

JP 2006-253074 9/2006

*Primary Examiner* — Travis S Chambers

(74) *Attorney, Agent, or Firm* — Gerald E. Hespos; Michael J. Porco; Matthew T. Hespos

(57) ABSTRACT

A housing (10) includes a terminal holding portion (12) and a fitting space (23) facing the front surface of the terminal holding portion (12). A retainer (33) is mounted in a front part of the terminal holding portion (12). The retainer (33) is movable between a partial locking position and a full locking position. A moving plate (44) facing the front surface of the retainer (33) is accommodated in the fitting space (23), and the moving plate (44) is formed with openings (48) penetrating in the front-rear direction. The retainer (33) is formed with operated portions (41) facing the openings (48) from behind, and a tool (51, 52, 54) inserted into the opening (48) can contact the operated portion (41).

7 Claims, 11 Drawing Sheets

(56) References Cited

U.S. PATENT DOCUMENTS

2006/0205264 A1 9/2006 Katsuma

* cited by examiner

CONNECTOR WITH A RETAINER OPERABLE BY A TOOL

BACKGROUND

Field of the Invention

The invention relates to a connector.

Related Art

Japanese Unexamined Patent Publication No. 2006-253074 discloses a male connector in which a receptacle projects forward from a terminal accommodating portion. Male terminal fittings are accommodated in the terminal accommodating portion, and tabs of the male terminal fittings project into the receptacle. A retainer, through which the tabs pass, is mounted into a front part of the terminal accommodating portion facing the receptacle. The retainer is movable in a front-rear direction between a partial locking position where the male terminal fittings are allowed to be inserted into and withdrawn from the terminal accommodating portion and a full locking position where the male terminal fittings properly inserted into the terminal accommodating portion are retained. A moving plate is accommodated in the receptacle for positioning the tabs penetrating therethrough. The moving plate is disposed to face the front surface of the retainer.

A prying preventing portion projects forward on the retainer and through the moving plate. The retainer can be displaced between the partial locking position and the full locking position by pinching the prying preventing portion with fingers and pushing or pulling the prying preventing portion. However, the projection of the prying preventing portion from the front surface of the retainer enlarges the retainer.

The invention was completed on the basis of the above situation and aims to reduce the size of a retainer.

SUMMARY

The invention is directed to a connector with a housing including a terminal holding portion and a fitting space facing a front surface of the terminal holding portion. A terminal fitting is held in the terminal holding portion and a tab at a front a front part of the terminal fitting projects into the fitting space. A retainer is mounted in a front part of the terminal holding portion and is movable between a partial locking position where the terminal fitting is allowed to be inserted into and withdrawn from the terminal holding portion and a full locking position where the properly inserted terminal fitting is retained. A moving plate is accommodated in the fitting space to face a front surface of the retainer and is configured to position the tab. An opening penetrates through the moving plate in a front-rear direction, and a tool is insertable into the opening from the front of the moving plate. An operated portion is formed in the retainer to face the opening from behind and can be contacted by the tool inserted into the opening.

The retainer can be moved between the partial locking position and the full locking position by inserting the tool into the opening from the front of the moving plate and operating the operated portion by the tool. Thus, the retainer need not be formed with an elongated projection projecting forward, and the retainer can be reduced in size.

The full locking position may be set behind the partial locking position, and the operated portion may have a pushing surface facing forward of the retainer. According to this configuration, the retainer can be moved from the partial locking position to the full locking position by pushing the pushing surface by the tool inserted into the opening.

The housing may include a resiliently deflectable locking lance configured to retain the terminal fitting properly inserted into the terminal holding portion. The retainer may include a deflection restricting portion insertable into a deflection space for the locking lance, and the pushing surface may be formed on a front surface of the deflection restricting portion. According to this configuration, the deflection restricting portion functions as the pushing surface so that the shape of the retainer can be simplified.

The full locking position may be set behind the partial locking position, and the operated portion may have a hooking surface facing rearward of the retainer. According to this configuration, the retainer can be moved from the full locking position to the partial locking position by hooking the tool inserted into the opening to the hooking surface and pulling the tool forward.

The housing may include a resiliently deflectable locking lance configured to retain the terminal fitting properly inserted into the terminal holding portion, and the opening may be disposed at a position facing the locking lance from the front. According to this configuration, the locking lance can be deflected resiliently and separated from the terminal fitting by the tool inserted into the opening from the front of the moving plate.

DETAILED DESCRIPTION

One specific embodiment of the invention is described with reference to FIGS. 1 to 11. Note that, in the following description, a left side in FIGS. 1, 3 to 7, 9 and 11 is defined as a front side concerning a front-rear direction. Upper and lower sides shown in FIGS. 1 to 8, 10 and 11 are directly defined as upper and lower sides concerning a vertical direction.

Figure 3:
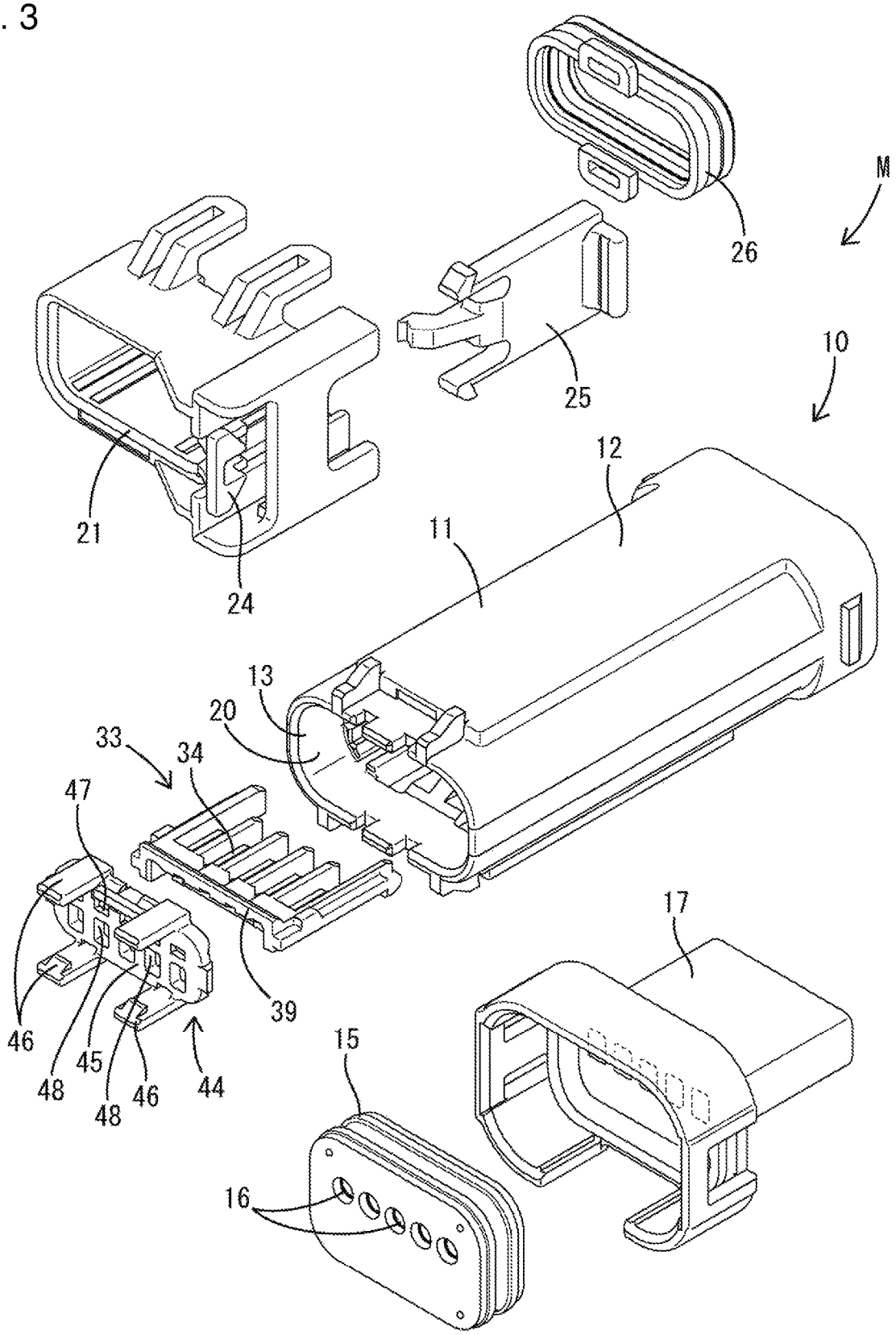
FIG. 3 is an exploded perspective view of a housing.
Figure 11:
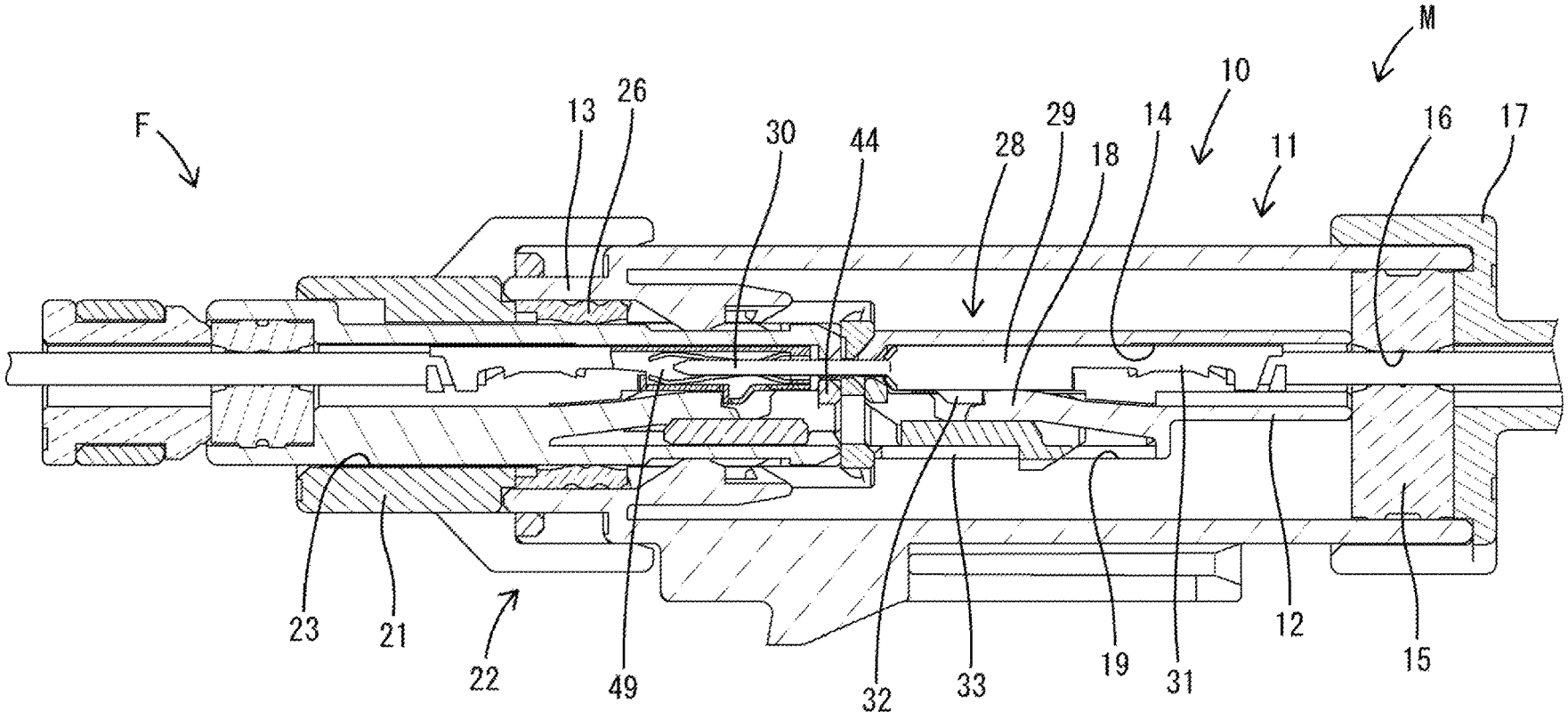
FIG. 11 is a side view in section showing a state where the male connector and a female connector are connected.

A male connector M (connector as claimed) of this embodiment is connectable to a female connector F (see FIG. 11). The female connector F is in the form of a block long in the front-rear direction. Female terminal fittings 49 are accommodated in parallel in a lateral direction in the female connector F. As shown in FIG. 3, the male connector M includes a housing 10, a one-piece rubber plug 15, a rear housing 17, a male terminal fittings 28 (terminal fitting as claimed), a retainer 33 and a moving plate 44.

<Housing 10>

The housing 10 is configured by assembling a housing body 11 made of synthetic resin, a front receptacle 21, a connection detecting member 25 and a seal ring 26. The housing body 11 is a single member including a terminal holding portion 12 and a tubular portion 13 projecting forward from the outer peripheral edge of a front end part of the terminal holding portion 12.

As shown in FIGS. 4 to 7 and 11, a plurality of terminal accommodation chambers 14 penetrating through the terminal holding portion 12 in the front-rear direction are formed in parallel in the lateral direction in the terminal holding portion 12. As shown in FIG. 11, the one-piece rubber plug 15 including a plurality of sealing holes 16 individually corresponding to the respective terminal accommodation chambers 14 is mounted in a rear end part of the housing body 11. The one-piece rubber plug 15 is held assembled with the housing body 11 by the rear housing 17 mounted on the housing body 11. The male terminal fitting 28 passed through the sealing hole 16 from behind the housing body 11 is inserted into each terminal accommodation chamber 14.

As shown in FIGS. 4 to 7, a locking lance 18 cantilevered forward along a lower wall portion constituting the terminal accommodation chamber 14 is formed in each terminal accommodation chamber 14. The locking lance 18 is resiliently deflectable in a direction away from the terminal accommodation chamber 14 (downward). The terminal holding portion 12 is formed with deflection spaces 19 for allowing resilient deflection of the locking lances 18. A mold removal space 20 open forward of the housing body 11 (terminal holding portion 12) is formed in front of the locking lances 18 and the deflection spaces 19.

Figure 1:
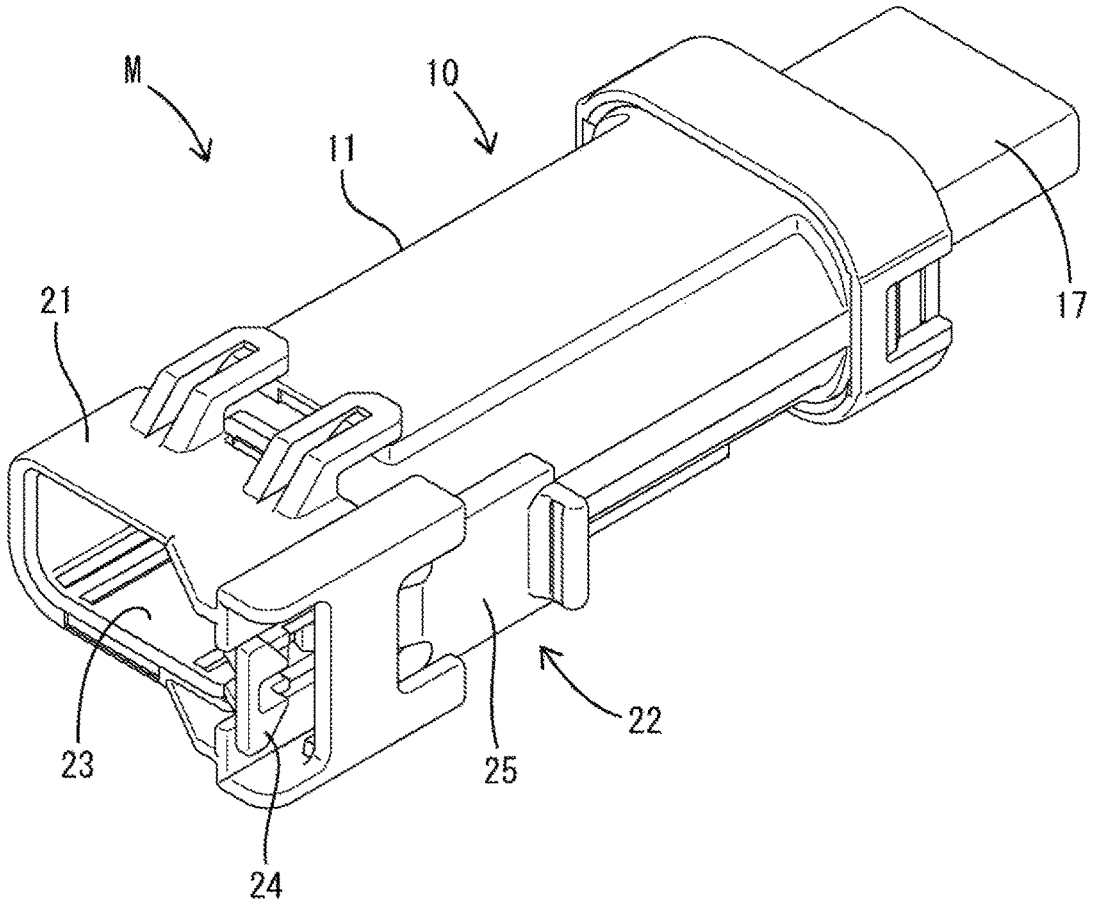
FIG. 1 is a perspective view of a male connector of an embodiment.
Figure 2:
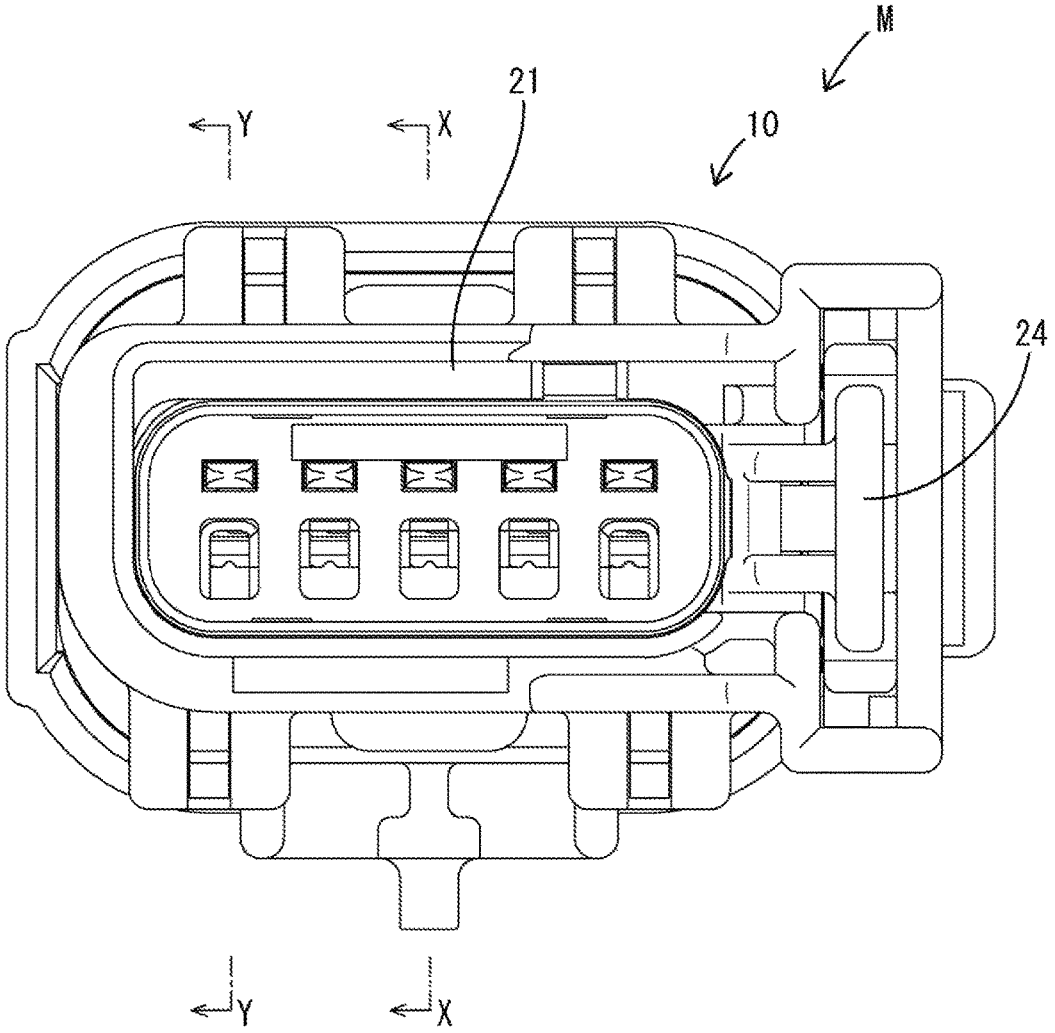
FIG. 2 is a front view of the male connector.

As shown in FIGS. 1 and 11, the tubular front receptacle 21 is coaxially mounted on the front end part of the housing body 11 (tubular portion 13). The front receptacle 21 is so mounted that the connection detecting member 25 is movable between an initial position and a detection position in front of the initial position. In a state where the both connectors F, M are not connected or are incompletely connected, the connection detecting member 25 is held at the initial position and cannot be moved to the detection position. When the both connectors F, M are properly connected, the connection detecting member 25 can be pushed from the initial position to the detection position.

The receptacle 22 is configured by assembling the front receptacle 21 with the tubular portion 13. An internal space of the receptacle 22 serves as a fitting space 23 open forward of the housing 10. The female connector F is fit into the fitting space 23 from front. When the female connector F is properly fit into the receptacle 22, a lock arm 24 integrally formed to the front receptacle 21 locks the female connector F and the both connectors F, M are locked in a connected state by this locking action.

<Male Terminal Fittings 28>

Figure 4:
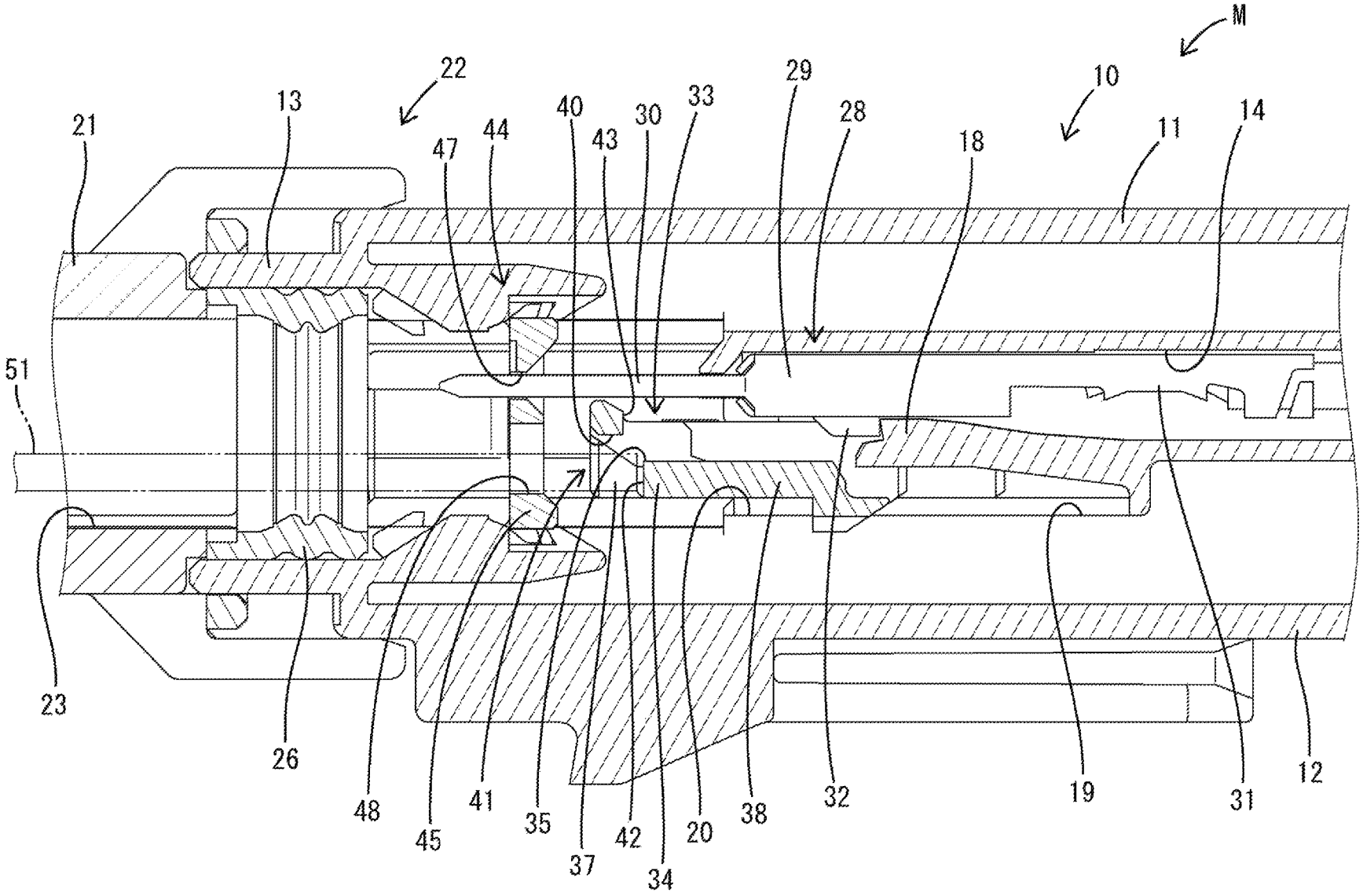
FIG. 4 is a side view in section along X-X of FIG. 2 showing a state where a moving plate is at a standby position and a retainer is at a partial locking position.

As shown in FIG. 4, the male terminal fitting 28 has an elongated shape in the front-rear direction as a whole. The male terminal fitting 28 is a single component including a terminal body 29, a tab 30 cantilevered forward from the front end of the terminal body portion 29 and a wire crimping portion 31 in the form of an open barrel extending rearward from the rear end of the terminal body 29. A locking projection 32 is formed on the lower surface of the terminal body 29. A front part of a wire (not shown) is conductively fixed to the wire crimping portion 31.

The male terminal fitting 28 is inserted into the terminal accommodation chamber 14 through the rear holder 17 and the one-piece rubber plug 15 from behind the housing 10. Since the terminal body 29 interferes with the locking lance 18 in the process of inserting the male terminal fitting 28, the locking lance 18 is resiliently deformed to retract toward the deflection space 19. When the male terminal fitting 28 is inserted properly, the locking lance 18 resiliently returns to lock the locking projection 32. By this primary locking action by the locking lance 18, the male terminal fitting 28 is held in a retained state with a rearward movement thereof restricted. In pulling out the male terminal fitting 28 inserted into the terminal accommodation chamber 14 rearward, the locking lance 18 is separated from the locking projection 32 by being resiliently displaced toward the deflection space 19 and the wire is pulled rearward with that separated state maintained.

<Retainer 33>

Figure 7:
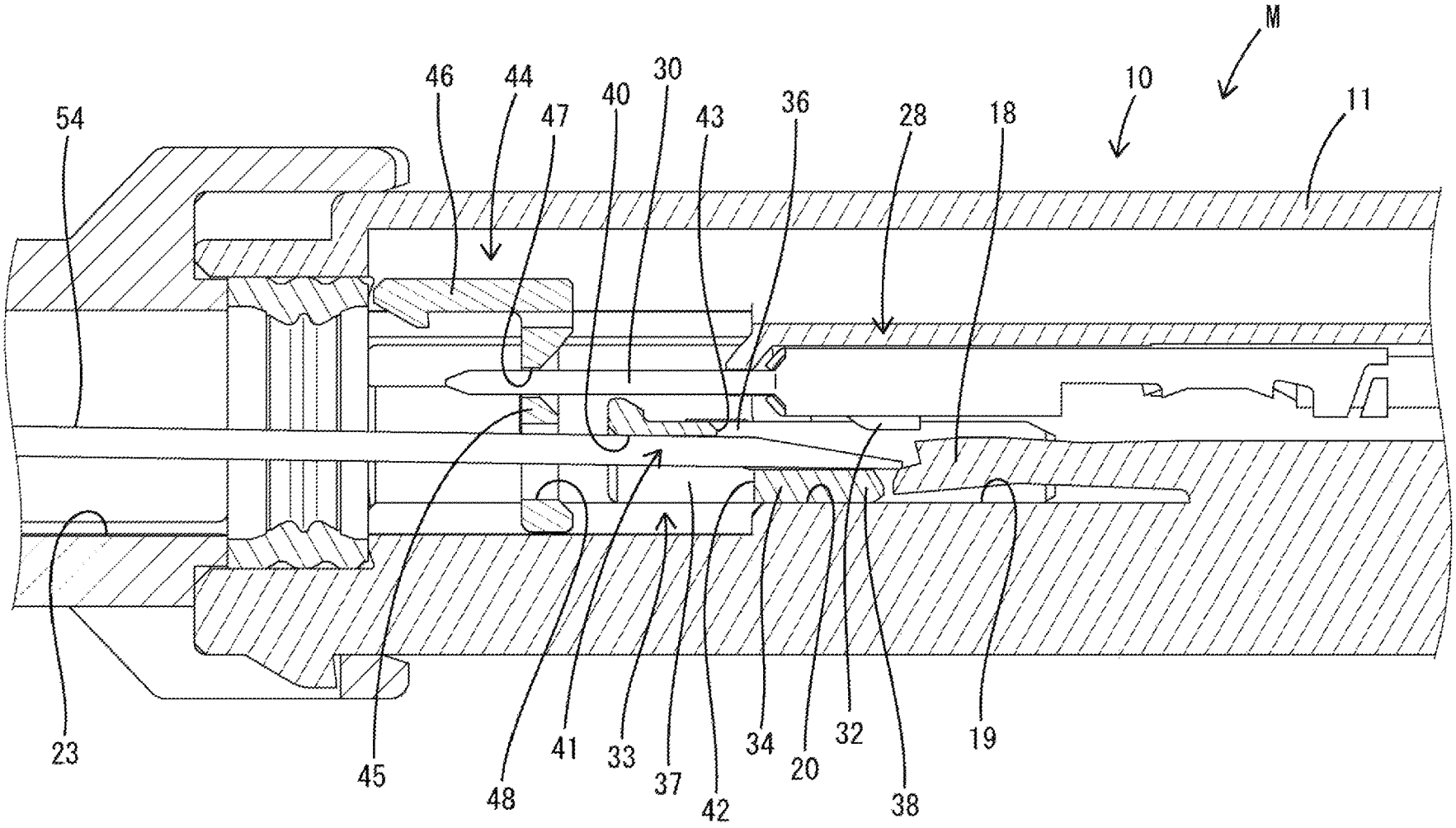
FIG. 7 is a side view in section along Y-Y of FIG. 2 showing a state where a locking lance is separated from a terminal fitting by a tool.
Figure 8:
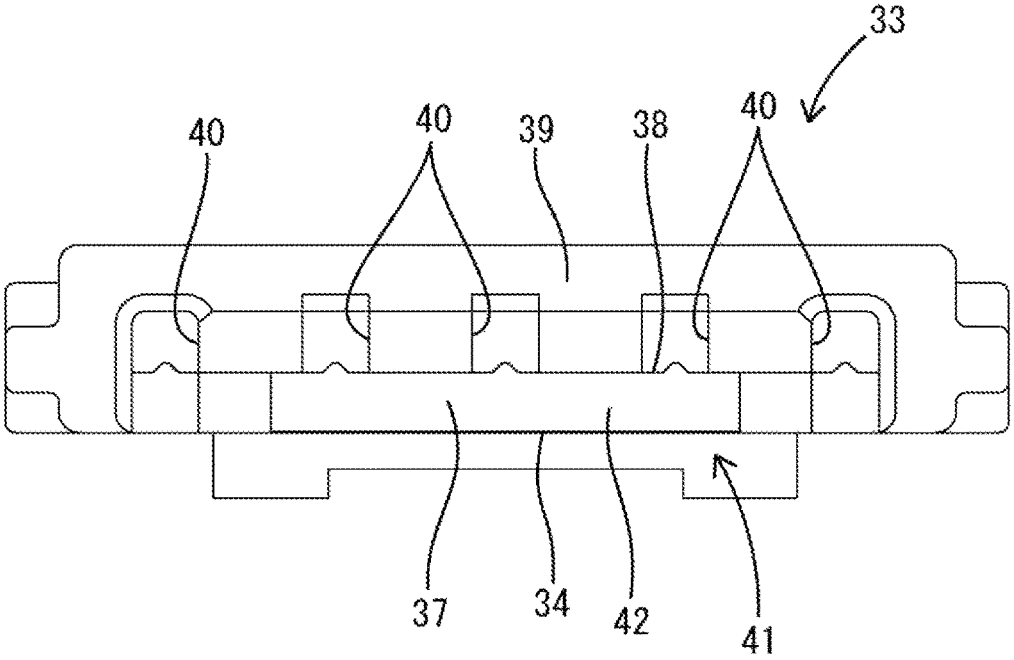
FIG. 8 is a front view of the retainer.
Figure 9:
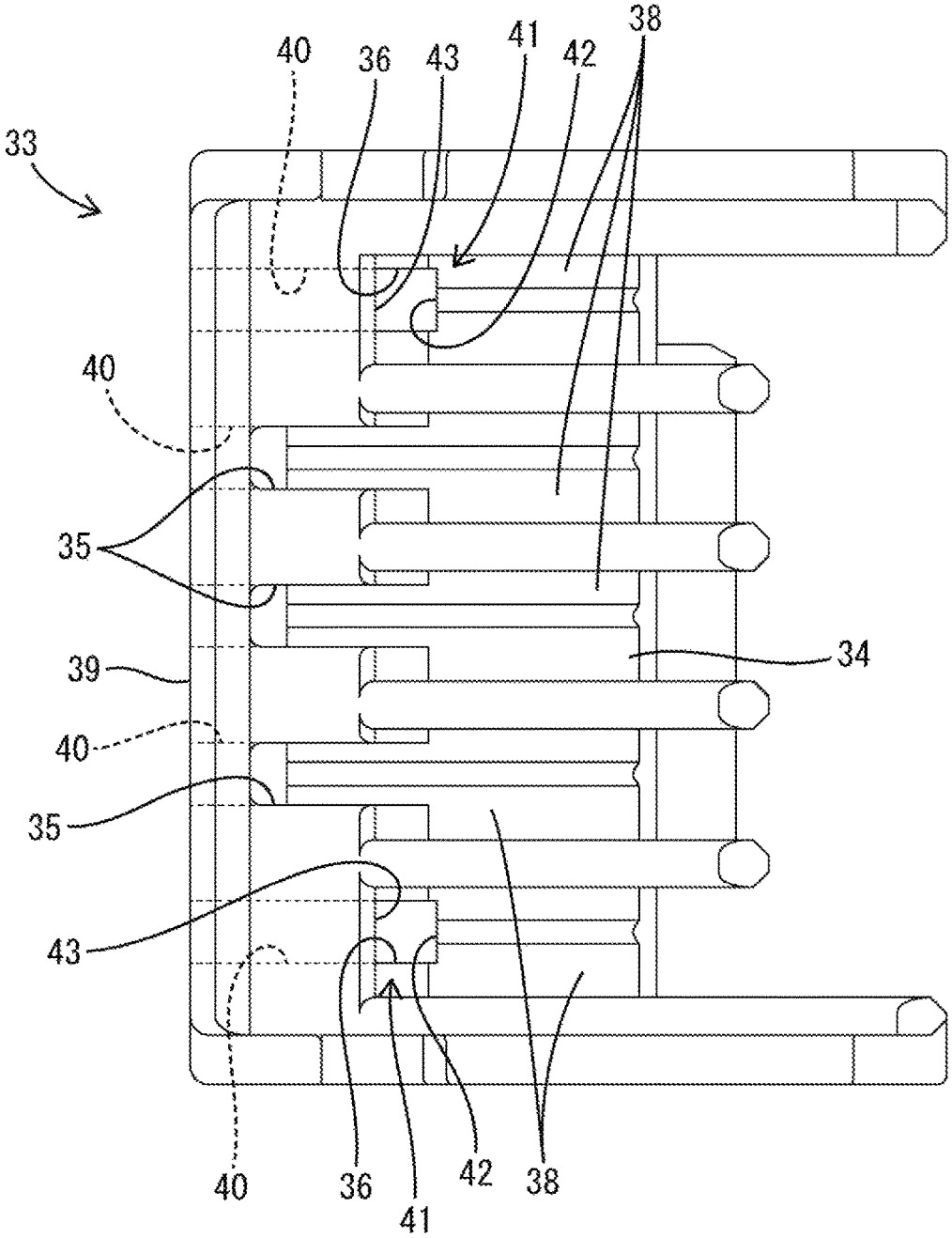
FIG. 9 is a plan view of the retainer.

The retainer 33 is inserted into the receptacle 22 from the front of the housing 10 and mounted in the front part of the terminal holding portion 12. The retainer 33 is movable in the front-rear direction between a partial locking position (see FIGS. 4 and 7) and a full locking position (see FIGS. 5, 6 and 11) behind the partial locking position. As shown in FIGS. 3, 8 and 9, the retainer 33 is a single component with a base 34 and a front wall 39.

The base 34 is substantially in the form of a flat plate parallel to a moving direction of the retainer 33 between the partial locking position and the full locking position. A thickness direction of the base 34 is substantially parallel to a resilient deflecting direction of the locking lance 18. As shown in FIG. 9, the base 34 is formed with first cuts 35 and left and right second cuts 36. The first cuts 35 penetrate through the base 34 in the vertical direction (thickness direction), and are disposed in a laterally central region of the base 34 while being spaced apart in the lateral direction. The seconds 36 penetrate through the base 34 in the vertical direction, and are disposed on both left and right end parts of the base 34. These cuts 35, 36 are arranged at the same intervals as the plurality of terminal accommodation chambers 14 in the lateral direction, and individually correspond to the terminal accommodation chambers 14. A communication space 37 communicating with the front ends of the cuts 35, 36 and open forward of the retainer 33 (base 34) is formed in a front part of the base 34 (see FIG. 8).

Elongated regions of the base 34 behind and adjacent to the respective cuts 35, 36 function as deflection restricting portions 38. When the retainer 33 is at the partial locking position, the deflection restricting portions 38 are located forward of the deflection spaces 19. Thus, the locking lances 18 can be resiliently deflected in a direction separating or away from the male terminal fittings 28 while entering the deflection spaces 19. When the retainer 33 is at the full locking position, the deflection restricting portions 38 are located in the deflection spaces 19. Thus, resilient deflection of the locking lances 18 in the direction separating from the male terminal fittings 28 is restricted.

The front wall 39 rises up from a front end of the base 34. The front wall 39 is formed with operation holes 40 penetrating through the front wall 39 in the front-rear direction and individually corresponding to the respective terminal accommodation chambers 14. The operation holes 40 are arranged at the same intervals as the terminal accommodation chambers 14 and the cuts 35, 36 in the lateral direction. The lower surface of each operation hole 40 is open downward of the retainer 33 (base 34) via the communication space 37. The operation holes 40 and the cuts 35, 36 are arranged one after the other communicate with each other in the communication space 37.

The retainer 33 is formed with operated portions 41 individually corresponding to the respective cuts 35, 36 and the respective operation holes 40. The operated portion 41 has a pushing surface 42 and a hooking surface 43. The front surface of each deflection restricting portion 38 is a flat surface at a right angle to the front-rear direction (moving direction of the retainer 33 from the partial locking position to the full locking position) and functions as the pushing surface 42. The pushing surface 42 is a surface defining the cut portion 35, 36 and open forward of the retainer 33 via the communication space 37. The hooking surface 43 is formed on an opening edge part on the rear end of each operation hole 40 and facing rearward.

<Moving Plate 44>

Figure 10:
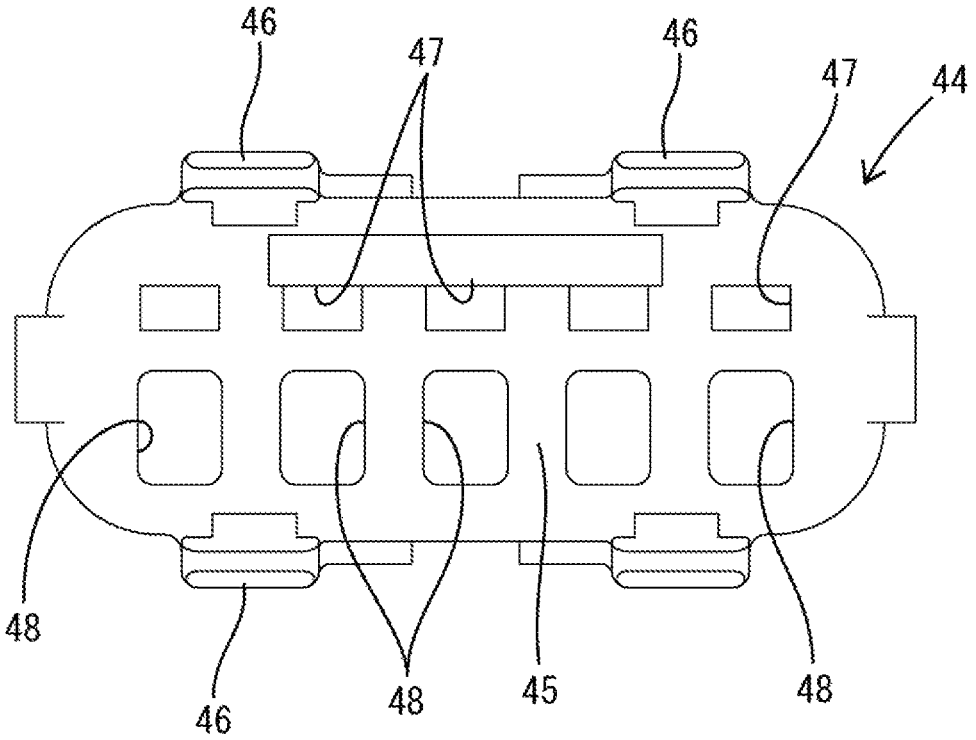
FIG. 10 is a front view of the moving plate.

The moving plate 44 is accommodated into the receptacle 22 to face the front surface of the retainer 33 and movable in the front-rear direction between a standby position and a connection position. As shown in FIG. 10, the moving plate 44 is a single component including a plate body 45 in the form of a flat plate whose plate thickness direction is oriented in the front-rear direction and guide arms 46 cantilevered forward from the plate body 45. The moving plate 44 is movable in the front-rear direction between the standby position (see FIGS. 4 to 7) and the connection position behind the standby position by causing the guide arms 46 to slide in contact with the inner periphery of the receptacle 22.

The plate body 45 is formed with positioning holes 47 penetrating in the front-rear direction (plate thickness direction of the plate body 45). The positioning holes 47 are arranged to individually face the terminal accommodation chambers 14 in the front-rear direction. The tabs 30 are passed through the positioning holes 47 and positioned in directions (vertical direction and lateral direction) perpendicular to a connecting direction of the both connectors F, M (moving direction of the moving plate 44).

The plate body 45 is formed with openings 48. The openings 48 are located individually right below the positioning holes 47. The openings 48 are arranged to individually face the pushing surfaces 42 in the front-rear direction. Further, the opening edges (upper edges) of the operation holes 40 where the hooking surfaces 43 are formed are located behind the openings 48 (see FIG. 6).

Functions of Embodiment

In mounting the male terminal fitting 28 into the housing 10, the male terminal fitting 28 is inserted into the terminal accommodation chamber 14 from behind the housing 10 with the moving plate 44 held at the standby position and the retainer 33 held at the partial locking position. In the process of inserting the male terminal fitting 28, the locking lance 18 is displaced resiliently to retract toward the deflection space 19 due to interference with the male terminal fitting 28. When the male terminal fitting 28 reaches a proper insertion position, the locking lance 18 resiliently returns to lock the locking projection 32 of the male terminal fitting 28, wherefore the male terminal fitting 28 is retained by the locking lance 18.

After the insertion of all the male terminal fittings 28 is completed, a pushing tool 51 (tool as claimed) is inserted successively into the opening 48 of the moving plate 44 in the fitting space 23 and the communication space 37 from the front of the housing 10 and pushes the pushing surface 42 of the retainer 33 with a tip of the pushing tool 51, as shown in FIG. 4. The pushing surface 42 can be confirmed visually through the opening 48 when the inside of the receptacle 22 is seen from the front of the housing 10. Thus, an operation of pushing the pushing surface 42 with the tip of the pushing tool 51 is performed easily.

Figure 5:
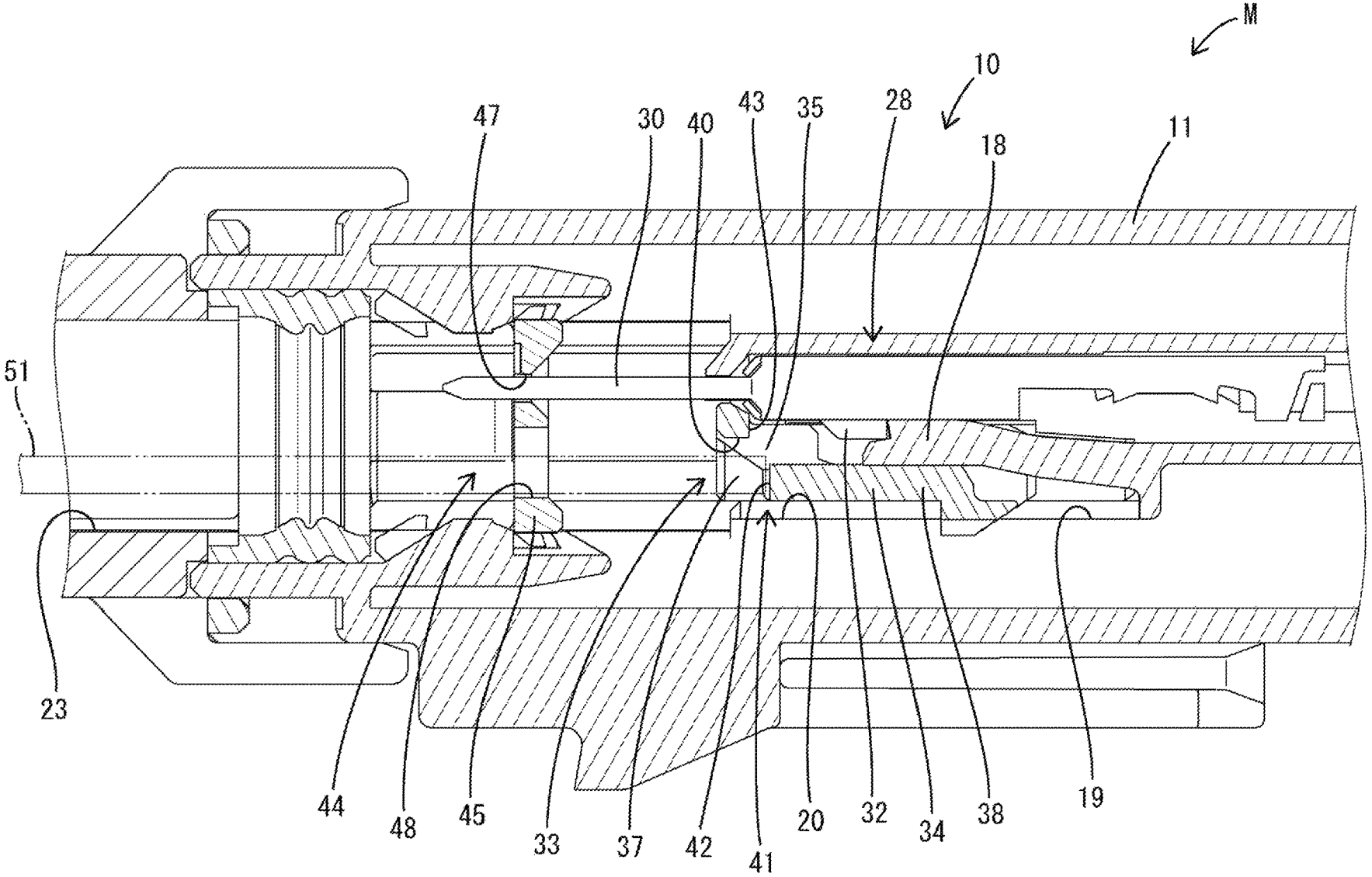
FIG. 5 is a side view in section along X-X of FIG. 2 showing a state where the moving plate is at the standby position and the retainer is at a full locking position.

If all the male terminal fittings 28 are inserted properly, the retainer 33 is pushed from the partial locking position to the full locking position and the deflection restricting portions 38 enter the deflection spaces 19 as shown in FIG. 5. By the entrance of the deflection restricting portions 38 into the deflection spaces 19, resilient displacements of the locking lances 18 into the deflection spaces 19 are restricted and the locking lances 18 are held in a state to lock the male terminal fittings 28 (locking projections 32). In this way, the male terminal fittings 28 are retained reliably.

If there is any male terminal fitting 28 left in an insufficiently inserted state, the locking lance 18 interfering with that male terminal fitting 28 is located in the deflection space 19. Thus, if an attempt is made to push the retainer 33 to the full locking position, the deflection restricting portion 38 interferes with the locking lance 18 located in the deflection space 19. Therefore, the retainer 33 cannot be pushed to the full locking position and the presence of the male terminal fitting 28 in the insufficiently inserted state can be detected.

The female connector F is fit into the receptacle 22 (fitting space 23) to connect the female connector F to the male connector M having the male terminal fittings 28 mounted in the housing 10. The front surface (right surface in FIG. 11) pushes the plate body 45 of the moving plate 44 in the process of fitting the female connector F. Thus, the female connector F and the moving plate 44 move to a back side of the fitting space 23. During this time, the tabs 30 of the male terminal fittings 28 are inserted into the female connector F while being positioned by the positioning holes 47 of the moving plate 44. When the connectors F, M reach the properly connected state, the moving plate 44 reaches the connection position and the female terminal fittings 49 and the male terminal fittings 28 are connected.

In the process of separating the connectors F, M in the connected state, the moving plate 44 at the connection position is moved forward integrally with the female connector F due to an unillustrated coupling structure and returns to the standby position. When the moving plate 44 returns to the standby position, the female connector F and the moving plate 44 are uncoupled so that the female connector F is separated forward of the receptacle 22 (fitting space 23) with the moving plate 44 held at the standby position.

Figure 6:
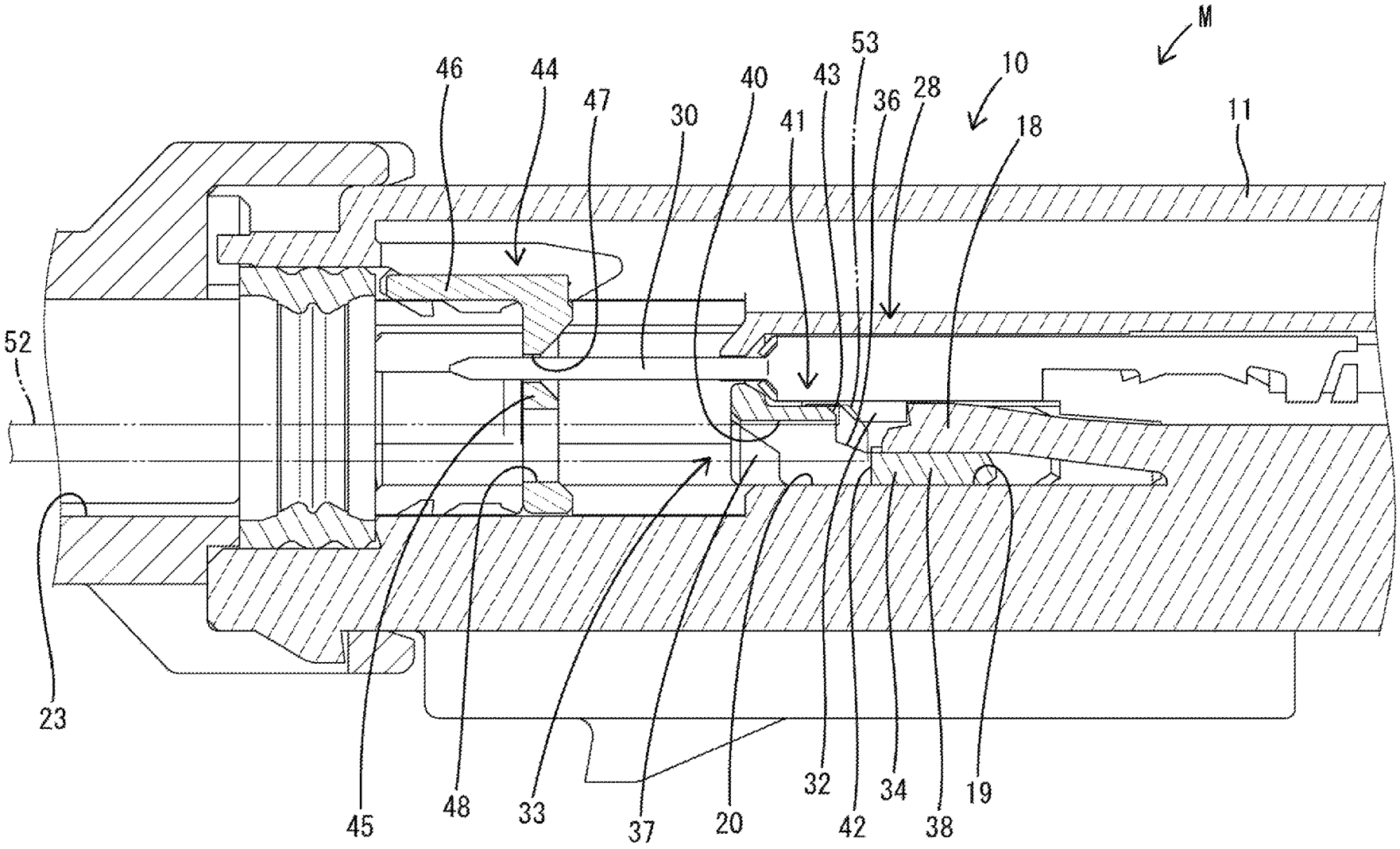
FIG. 6 is a side view in section along Y-Y of FIG. 2 showing the state where the moving plate is at the standby position and the retainer is at the full locking position.

In withdrawing the male terminal fitting 28 from the housing 10 with the female connector F separated from the male connector M, the retainer 33 at the full locking position first is pulled back to the partial locking position. At this time, as shown in FIG. 6, a pull-back tool 52 (tool as claimed) is inserted successively into the opening 48 of the moving plate 44 in the fitting space 23 and the operation hole 40 from the front of the housing 10, and a hook 53 on the tip of the pull-back tool 52 is hooked to the hooking surface 43 of the retainer 33 from behind. If the pull-back tool 52 is moved forward with the hook 53 hooked to the hooking surface 43, the retainer 33 at the full locking position is pulled back to the partial locking position. In this way, the deflection restricting portions 38 are retracted forward of the deflection spaces 19 and the locking lances 18 can be displaced resiliently into the deflection spaces 19.

After the retainer 33 is moved to the partial locking position, the pull-back tool 52 is pulled from the retainer 33 (operation hole 40) and the moving plate 44 (opening 48). Thereafter, as shown in FIG. 7, an unlocking tool 54 (tool as claimed) is successively inserted into the opening 48 of the moving plate 44 in the fitting space 23 and the operation hole 40 from the front of the housing 10, a tip of the unlocking tool 54 is brought into contact with a front end part of the locking lance 18 and the locking lance 18 is resiliently displaced down (toward the deflection space 19). Since the retained state of the male terminal fitting 28 by the locking lance 18 is released by the resilient displacement of the locking lance 18, the male terminal fitting 28 may be withdrawn from the terminal accommodation chamber 14 by gripping the wire with the locking lance 18 kept displaced.

The male connector M of this embodiment includes the housing 10, the male terminal fittings 28, the retainer 33 and the moving plate 44. The housing 10 includes the terminal holding portion 12 and the fitting space 23 facing the front surface of the terminal holding portion 12. The male terminal fitting 28 includes the tab 30 in the front part, and held in the terminal holding portion 12 with the tab 30 projecting into the fitting space 23. The retainer 33 is mounted in the front part of the terminal holding portion 12. The retainer 33 is movable in the front-rear direction between the partial locking position where the male terminal fittings 28 are allowed to be inserted into and withdrawn from the terminal holding portion 12 and the full locking position where the male terminal fittings 28 properly held in the terminal holding portion 12 are retained. The moving plate 44 has a function of positioning the tabs 30 and is accommodated in the fitting space 23 to face the front surface of the retainer 33.

The openings 48 penetrate the moving plate 44 in the front-rear direction, and the pushing tool 51, the pull-back tool 52 and the unlocking tool 54 are insertable into the openings 48 from the front of the moving plate 44. The retainer 33 is formed with the operated portions 41 facing the openings 48 from behind and contactable by the pushing tool 51, the pull-back tool 52 and the unlocking tool 54 inserted into the opening 48.

By pushing the operated portion 41 by the pushing tool 51 inserted into the opening 48 from the front, the retainer 33 can be moved from the partial locking position to the full locking position. Further, by pulling the operated portion 41 by the pull-back tool 52 inserted into the opening 48 from the front, the retainer 33 can be moved from the full locking position to the partial locking position. Since the retainer 33 need not be formed with elongated projections projecting forward, the retainer 33 can be reduced in size.

Further, the full locking position of the retainer 33 is behind the partial locking position and the operated portions 41 have the pushing surfaces 42 facing forward of the retainer 33. Accordingly, the retainer 33 can be moved from the partial locking position to the full locking position by pushing the pushing surface 42 by the pushing tool 51 inserted into the opening 48. Further, the housing 10 includes the resiliently deflectable locking lances 18 to retain the male terminal fittings 28 in the terminal holding portion 12. The retainer 33 includes the deflection restricting portions 38 insertable into the deflection spaces 19 for the locking lances 18, and the pushing surfaces 42 are on the front surfaces of the deflection restricting portions 38. Accordingly, since the deflection restricting portions 38 function as the pushing surfaces 42, the shape of the retainer 33 can be simplified.

Further, the full locking position of the retainer 33 is set behind the partial locking position and the operated portions 41 have the hooking surfaces 43 facing rearward of the retainer 33. According to this configuration, the retainer 33 can be moved from the full locking position to the partial locking position by hooking the pull-back tool 52 inserted into the opening 48 to the hooking surface 43 and pulling the pull-back tool 52 forward.

Further, the housing 10 includes the resiliently deflectable locking lances 18 configured to retain the male terminal fittings 28 properly inserted into the terminal holding portion 12, and the openings 48 are disposed at positions facing the locking lances 18 from front. According to this configuration, the locking lance 18 can be deflected resiliently and separated from the male terminal fitting 28 by the unlocking tool 54 inserted into the opening 48 from the front of the moving plate 44.

The invention is not limited to the above described and illustrated embodiment. For example, the following embodiments also are included in the scope of the invention.

Although the operated portion has the pushing surface for pushing the retainer to the full locking position and the hooking surface for pulling the retainer back to the partial locking position in the above embodiment, the operated portion may have only either one of the pushing surface and the hooking surface.

Although the invention is applied to a waterproof connector in the above embodiment, the present invention can also be applied to a non-waterproof connector.

Although the locking lance can be separated from the terminal fitting using the opening in the above embodiment, the locking lance may be separated from the terminal fitting using an opening other than the former opening.

Although the opening is at the position facing the locking lance from front in the above embodiment, the opening may be disposed at a position not facing the locking lance.

Although the opening edge of the opening is continuous over the entire periphery in the above embodiment, a part of the opening edge may be open on the outer peripheral edge of the moving plate.

LIST OF REFERENCE SIGNS

M . . . male connector (connector)
10 . . . housing
12 . . . terminal holding portion
18 . . . locking lance
19 . . . deflection space
23 . . . fitting space
28 . . . male terminal fitting (terminal fitting)
30 . . . tab
33 . . . retainer
38 . . . deflection restricting portion
41 . . . operated portion
42 . . . pushing surface
43 . . . hooking surface
44 . . . moving plate
48 . . . opening
51 . . . pushing tool (tool)
52 . . . pull-back tool (tool)
54 . . . unlocking tool (tool)

What is claimed is:

1. A connector, comprising:

a housing including a terminal holding portion and a fitting space facing a front surface of the terminal holding portion;

a terminal fitting including a tab in a front part and held in the terminal holding portion with the tab projecting into the fitting space;

a retainer mounted in a front end part of the terminal holding portion and movable between a partial locking position where the terminal fitting is allowed to be inserted into and withdrawn from the terminal holding portion and a full locking position where the terminal fitting properly held in the terminal holding portion is retained;

a moving plate accommodated into the fitting space to face a front surface of the retainer and configured to position the tab;

an opening penetrating through the moving plate in a front-rear direction, a tool being insertable into the opening from the front of the moving plate; and an operated portion formed in the retainer to face the opening from behind and contactable by the tool inserted into the opening, wherein:

the full locking position is set behind the partial locking position; and the operated portion has a pushing surface facing forward of the retainer.

2. The connector of claim 1, wherein claim 1, wherein:

the housing includes a resiliently deflectable locking lance configured to retain the terminal fitting properly inserted into the terminal holding portion; and the opening is disposed at a position facing the locking lance from the front.

3. The connector of claim 1, wherein:

the housing includes a resiliently deflectable locking lance configured to retain the terminal fitting properly inserted into the terminal holding portion;

the retainer includes a deflection restricting portion insertable into a deflection space for the locking lance; and the pushing surface is formed on a front surface of the deflection restricting portion.

4. The connector of claim 3, wherein:

the operated portion has a hooking surface facing rearward of the retainer.

5. A connector, comprising:

a housing including a terminal holding portion and a fitting space facing a front surface of the terminal holding portion;

a terminal fitting including a tab in a front part and held in the terminal holding portion with the tab projecting into the fitting space;

a retainer mounted in a front end part of the terminal holding portion and movable between a partial locking position where the terminal fitting is allowed to be inserted into and withdrawn from the terminal holding portion and a full locking position where the terminal fitting properly held in the terminal holding portion is retained;

a moving plate accommodated into the fitting space to face a front surface of the retainer and configured to position the tab;

an opening penetrating through the moving plate in a front-rear direction, a tool being insertable into the opening from the front of the moving plate; and an operated portion formed in the retainer to face the opening from behind and contactable by the tool inserted into the opening, wherein:

the full locking position is set behind the partial locking position; and the operated portion has a hooking surface facing rearward of the retainer.

6. The connector of claim 5, wherein:

the full locking position is set behind the partial locking position; and the operated portion has a pushing surface facing forward of the retainer.

7. The connector, comprising:

a housing including a terminal holding portion and a fitting space facing a front surface of the terminal holding portion;

a terminal fitting including a tab in a front part and held in the terminal holding portion with the tab projecting into the fitting space;

a retainer mounted in a front end part of the terminal holding portion and movable between a partial locking position where the terminal fitting is allowed to be inserted into and withdrawn from the terminal holding portion and a full locking position where the terminal fitting properly held in the terminal holding portion is retained;

a moving plate accommodated into the fitting space to face a front surface of the retainer and configured to position the tab;

an opening penetrating through the moving plate in a front-rear direction, a tool) being insertable into the opening from the front of the moving plate; and an operated portion formed in the retainer to face the opening from behind and contactable by the tool inserted into the opening, wherein:

the housing includes a resiliently deflectable locking lance configured to retain the terminal fitting properly inserted into the terminal holding portion; and the opening is disposed at a position facing the locking lance from the front.

* * * * *